US006827522B2

(12) United States Patent
Kodama et al.

(10) Patent No.: US 6,827,522 B2
(45) Date of Patent: Dec. 7, 2004

(54) LEFT-TURN DRIVING SUPPORT DEVICE

(76) Inventors: Kohichiro Kodama, 3-296-1C-1311, Shinmatsudo, Matsudo-shi, Chiba-ken (JP); Yoshihiro Kodama, Enjuochanomizu Building 3rd Floor, 17-2, Sotokanda 2-chome, Chiyoda-ku, Tokyo 101-0021 (JP)

( * ) Notice: Subject to any disclaimer, the term of this patent is extended or adjusted under 35 U.S.C. 154(b) by 0 days.

(21) Appl. No.: 09/976,665

(22) Filed: Oct. 10, 2001

(65) Prior Publication Data

US 2002/0061226 A1 May 23, 2002

(30) Foreign Application Priority Data

Oct. 11, 2000 (JP) ..... 2000-310229

(51) Int. Cl.[7] ..... E01F 9/00
(52) U.S. Cl. ..... 404/72
(58) Field of Search ..... 404/1, 9, 72; 116/63 R; 359/551, 552

(56) References Cited

U.S. PATENT DOCUMENTS 1,791,936 A * 2/1931 Rolph ..... 359/528
1,837,085 A * 12/1931 van Gelder ..... 359/855
1,930,917 A * 10/1933 Wing ..... 359/862
2,164,985 A * 7/1939 Cardarelli ..... 40/610
3,200,705 A * 8/1965 Voelker et al. ..... 359/512
4,069,787 A * 1/1978 Wyckoff ..... 116/63 R
4,248,001 A * 2/1981 Feuvray ..... 40/602
4,737,049 A * 4/1988 Callhan ..... 359/551
4,978,207 A * 12/1990 Gillner et al. ..... 359/871
4,993,868 A * 2/1991 Eigenmann ..... 404/12
5,042,894 A * 8/1991 Swemer ..... 385/33
5,128,203 A * 7/1992 Laroche ..... 428/325
5,472,737 A * 12/1995 Anders ..... 427/137
5,665,793 A * 9/1997 Anders ..... 523/172
5,757,472 A * 5/1998 Wangler et al. ..... 356/4.01
6,084,709 A * 7/2000 Nakade ..... 359/532
6,190,085 B1 * 2/2001 Johansson ..... 404/6
6,264,334 B1 * 7/2001 Kushida ..... 359/515
6,290,362 B1 * 9/2001 Nakade ..... 359/532
6,305,874 B1 * 10/2001 Custers et al. ..... 404/9
6,370,475 B1 * 4/2002 Breed et al. ..... 701/301
6,398,399 B1 * 6/2002 Neophytou ..... 362/576
6,637,973 B1 * 10/2003 Kim ..... 404/9

FOREIGN PATENT DOCUMENTS

WO 00/44990 * 8/2000

* cited by examiner

*Primary Examiner*—Gary S. Hartmann
(74) *Attorney, Agent, or Firm*—Knobbe, Martens, Olson & Bear LLP

(57) ABSTRACT

A left-turn driving support system for supporting a driver of a vehicle waiting to make a left turn at an intersection where vehicles travel on the right side of a road. The system includes a light-reflecting material which reflects light from blinking signals of a turn signal of a second oncoming vehicle following a forefront oncoming vehicle, which are about to enter the intersection. The light-reflecting material is installed continuously along the centerline of the road and is sufficient long to detect a left-turn signal of the second oncoming vehicle.

1 Claim, 3 Drawing Sheets

LEFT-TURN DRIVING SUPPORT DEVICE

BACKGROUND OF THE INVENTION

1. Field of the Invention

The present invention relates to a left-turn driving support device where vehicles travel on the left side of a road. The device supports a driver's judgement on making a left turn by communicating driving information such as a left turn and a right turn of a second oncoming vehicle following the forefront oncoming vehicle, which are about to enter the intersection, to the driver of the left-turn vehicle. Adjustment needs to be made where vehicles travel on the right side of a road.

In the present invention, oncoming vehicles mean oncoming vehicles approaching the intersection in the opposite lane, the forefront oncoming vehicle means the first vehicle in the opposite lane, which is arriving at the intersection, and the second vehicle means a vehicle, which follows the forefront oncoming vehicle. Vehicles mean all the vehicles prescribed in traffic regulations.

2. Description of the Related Art

Prior to the present invention, means for supporting a driver making a left turn in an intersection are typically to provide a left-turn only lane, to provide a time-difference control for securing the safety of left-turn vehicles by switching a green traffic signal for the oncoming traffic to a yellow signal to a red signal earlier than a green signal for the traffic lane on the left-turn vehicle side, and to provide traffic signals with left-turn only arrows for the left-turn vehicles for securing the safety of left-turn vehicles.

There are, however, many intersections with traffic signals without the above-mentioned controls supporting left turns, or without traffic signals. In these intersections, the driver making a left turn has to make the judgment of whether the forefront oncoming vehicle goes straight on, turns left or turns right by looking at blinking signals of the forefront oncoming vehicle. If the forefront oncoming vehicle is through traffic or is turning right, the driver making a left turn is able to judge that it is safe to make a left turn by looking at the traveling distance from the oncoming vehicle and makes a left turn. If the forefront oncoming vehicle is making a left turn, the driver makes a left turn at ease. Since the judgement of making a left turn in such cases depends on the judgement of the driver who makes the left turn, it hardly need be said that there are judgement mistakes when making a left turn, and accidents between left-turn vehicles and oncoming through traffic occur frequently. If the second oncoming vehicle is about to make a left turn or a right turn (where it is easier for a left-turn vehicle to make a left turn than in a case where the second oncoming vehicle is about to go straight), it is out of the line of vision (obstructed by the forefront oncoming vehicle) of the driver of the waiting left-turn vehicle, and often he/she cannot visually check the vehicle's turn signals. Particularly, it is impossible for the driver of the waiting left-turn vehicle to see the turn signals if the forefront oncoming vehicle is a large-sized car.

Prior to the present invention, as technologies supporting making a left turn of a vehicle, there are, for example, in Japanese Patent Laid-open No. 1984-198000, a technology for securing the safety of a vehicle making a left turn by measuring time between a left-turn vehicle and the oncoming vehicle traveling before or after the left-turn vehicle and displaying the result of a calculation on a displaying device installed on the street by calculating whether making a left turn is possible or not based on the time measured, in Japanese Patent Laid-open No. 1993-2700, a technology for supporting making a left turn only when the driver of a left-turn vehicle cannot judge whether to make a left turn to support making a left turn by determining a possibility of a collision with the oncoming through traffic and by issuing an alarm inside the left-turn vehicle if a possibility of a collision exists, and in Japanese Patent Laid-open No. 1997-270097, a technology for creating information to judge to make a left turn by calculating whether a left-turn vehicle can make a left turn safely based on a traveling position of the oncoming through traffic from image signals received from an image sensor installed near an intersection and displayed data at a point of time from a signal controller controlling traffic signal lights and transmitting this information to a receiver installed in the left-turn vehicle for making the judgment to make a left turn. All of these technologies use microcomputer-based controls. As those which do not use the controls, there are technologies such as that in Japanese Patent Laid-open No. 1999-345395, a technology for preventing a collision with the above-mentioned second oncoming vehicle by installing a downward-looking concave mirror at the upper portion of a post set up near the traffic light of an intersection, widely reflecting objects passing through the street and allowing waiting left-turn vehicles to visually recognize a second oncoming vehicle following a first oncoming vehicle, particularly a large-sized vehicle, being making a left turn at the intersection, where the second oncoming vehicle is passing the side of the first oncoming left-turn vehicle to avoid the above-mentioned left-turn vehicle.

SUMMARY OF THE INVENTION

The above-mentioned conventional left-turn support devices basically intend to support making a left turn of a forefront vehicle entering an intersection. Because those devices include expensive controls such as microcomputers, their structure is complex and managing them is complicated. Additionally, in the case of the device using a concave mirror, if it extensively reflects the road surface, vehicles reflected were small and there was some possibility of failing to notice the second oncoming vehicle.

As a result of particularly examining traveling conditions at the intersection of a two-lane road, the inventors of the present invention found that not many accidents occurred between a vehicle making a left turn and a forefront oncoming vehicle on a road where the traffic is light, because the driver of the vehicle waiting to make a left turn can directly visually check whether the forefront oncoming vehicle entering the intersection is making a left turn or a right turn by looking at the blinking status of its turn signals. The inventors also found that collisions between a vehicle waiting to make a left turn and an oncoming vehicle frequently occurred at intersections where traffic is heavy. In view of these findings, the inventors came up with an idea for solving this problem.

Particularly on a road with heavy traffic, when a vehicle is waiting to make a left turn and if turning left of the forefront oncoming vehicle and second oncoming vehicle, both of which are entering the intersection, is clear to the driver of the waiting left-turn vehicle, there is no problem because the driver can discern the oncoming vehicles' intentions by looking at the turn signals. The driver of the waiting left-turn vehicle cannot make a decision quickly until making sure of not colliding with oncoming traffic because there is a case where even when the forefront oncoming vehicle is making a left turn, the second oncoming vehicle may be going straight on (so that the driver of the waiting left-turn vehicle cannot start making a left turn until the driver actually recognizes the direction of the second oncoming vehicle). The inventors achieved the present invention by turning their attention to the finding that the driver of a vehicle waiting to make a left turn can prepare him/herself for making the turn ahead of time if he/she can tell that the second oncoming vehicle is making a left turn.

By turning attention to the fact that in conformity to traffic regulations, if any, a driver has to use a turn signal in advance if making a left turn or a right turn, the problem to be solved by the present invention is to provide a left-turn driving support device which enables the waiting left-turn driver to make a judgement without pressure by surely and accurately communicating the traveling intentions of a second oncoming vehicle following the forefront oncoming vehicle. Because the driver of the second oncoming vehicle entering an intersection to make a left or right turn must always use a turn signal, the driver of the vehicle waiting to make a left turn immediately is able to detect that the turn signal of the second oncoming vehicle is on if blinking of the turn signal can be detected as an optical signal on or near the road surface.

When the forefront oncoming vehicle entering the intersection goes straight on and the second oncoming vehicle goes straight on as well, a vehicle making a left turn has to wait for the vehicles passing through. Turning left in the intersection is easy when the forefront oncoming vehicle goes straight on and the second oncoming vehicle makes a left turn, and when the second oncoming vehicle makes a right turn, the driver can safely make a left turn with necessary caution for avoiding a minor collision with an oncoming vehicle turning right is required to make a left turn. Based on these actual conditions, a left turn can be made safely if the driver of the waiting left-turn vehicle can discern the traveling intentions of the second oncoming vehicle, whether it goes straight on or makes a left or right turn, rather than the traveling intentions or direction of the forefront oncoming vehicle.

An aspect of the present invention provides a left-turn driving support system for a driver of a vehicle waiting for making a left turn at an intersection where vehicles travel on the left side of a road, comprising a light-emitting device which emits light upon sensing blinking signals of a turn signal of a second oncoming vehicle following a forefront oncoming vehicle, which are about to enter the intersection, said light-emitting device being installed in a position from which the driver of the vehicle waiting for making a left turn is able to see emitted light from the light-emitting device. The light-emitting device may be a luminescent material.

As a luminescent material, preferred are a reflecting mirror 4*a* which reflects blinking of a turn signal, a reflective paint 4*b* which reflects blinking of a turn signal, an optical fiber which at one end 4*c* senses light from blinking turn signals and emits light from the other end 4*d*, and a combination of a means for sensing light from blinking turn signals and a means for emitting light based on the signals sensed by the means for sensing light.

As a position from which a vehicle waiting to make a left turn on the road surface is able to visually check a luminescent material which emits light upon sensing blinking of turn signals of the second oncoming vehicle, in the case of the second oncoming vehicle making a left turn, installing the luminescent material at or near the center line within the limits of 30 m, for example, and extending in a zone from an intersection entrance in the entering direction of the intersection, which may be a distance prescribed in traffic regulations for regular passenger cars for turning on a turn signal before making a turn, is preferable. In the case of the second oncoming vehicle making a right turn, installing the luminescent material near the intersection is preferable.

The present invention can also apply to a method for supporting a driver to achieve the above objects.

For purposes of summarizing the invention and the advantages achieved over the prior art, certain objects and advantages of the invention have been described above. Of course, it is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

Further aspects, features and advantages of this invention will become apparent from the detailed description of the preferred embodiments which follow.

BRIEF DESCRIPTION OF THE DRAWINGS

These and other features of this invention will now be described with reference to the drawings of preferred embodiments which are intended to illustrate and not to limit the invention.

The symbols used in the figures are: 1: Left-turn vehicle; 2: Forefront oncoming vehicle; 3: Second oncoming vehicle following the forefront oncoming vehicle; 4: Luminescent material; 5: Sensor; 6: Light-emitting unit; 10: Intersection; 11: Signals.

DETAILED DESCRIPTION OF THE PREFERRED EMBODIMENT

Figure 1:
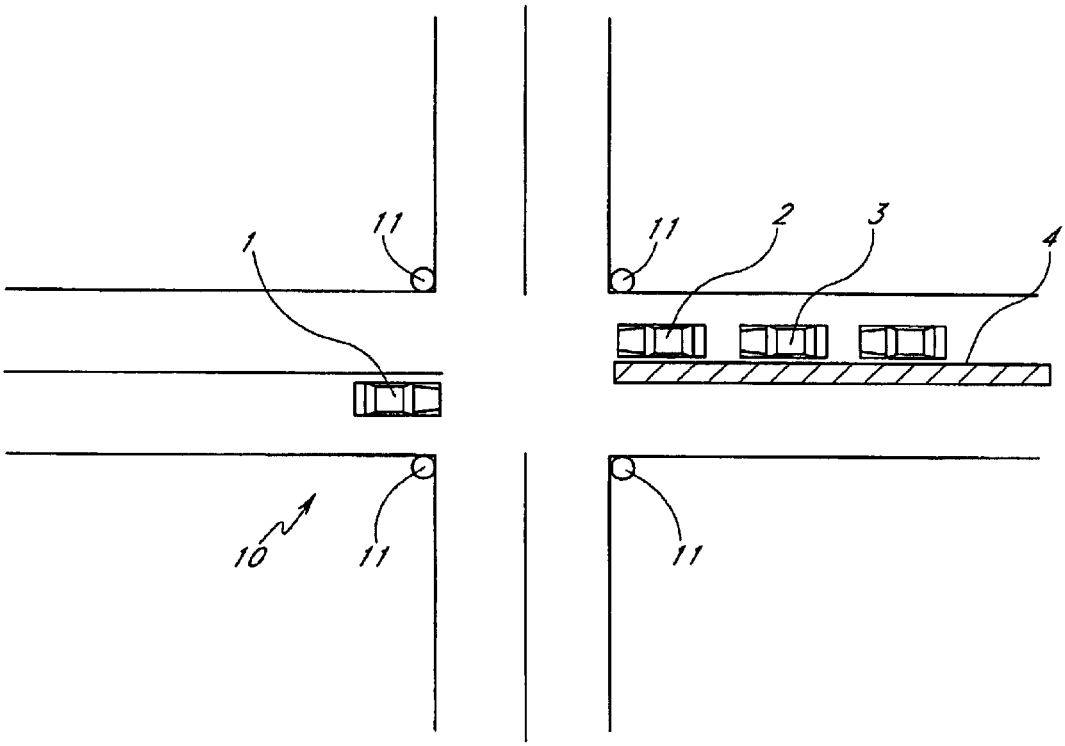
FIG. 1 shows an arrangement of the embodiment according to the present invention near an intersection.

Embodiments for carrying out the invention are described below referring to figures. FIG. 1 shows one embodiment for showing an arrangement near an intersection where the device according to the present invention is installed. In this embodiment, a case which supports the judgement of the driver of a vehicle 1 waiting in a right lane and waiting to make a left turn is described.

Figure 2:
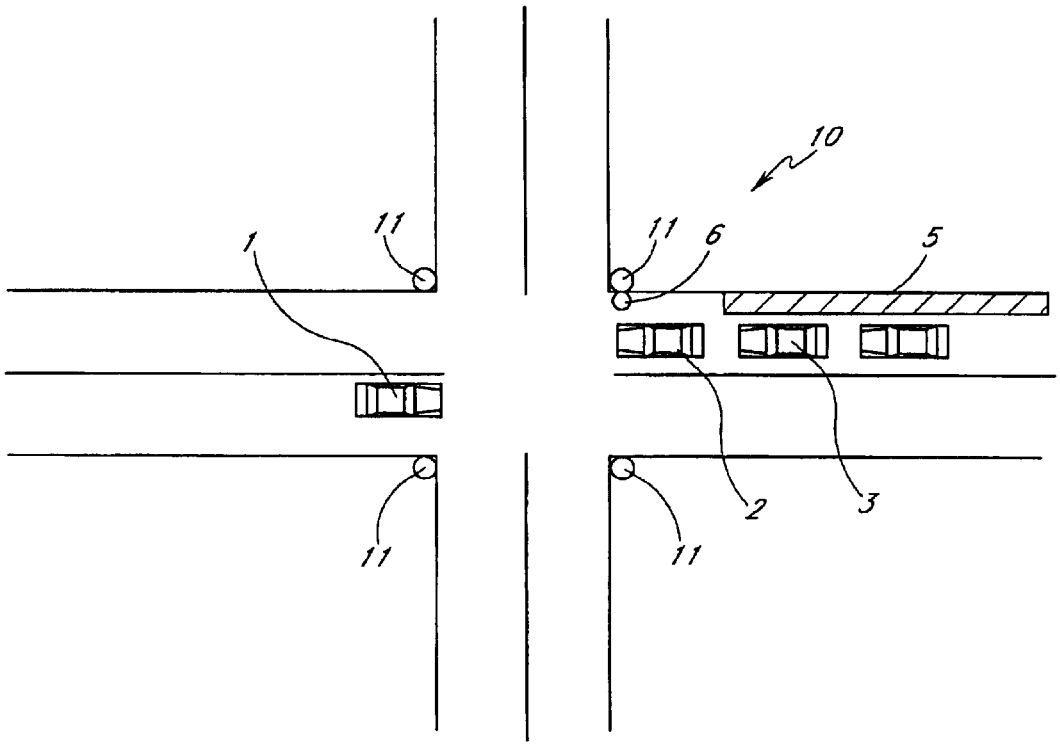
FIG. 2 shows an arrangement of another embodiment according to the present invention near an intersection.

FIG. 2 shows only the arrangement of another embodiment supporting the vehicle 1 waiting to make a left turn.

Additionally, for left-turn vehicles waiting in the lanes vertically extending in the figures, devices are respectively installed in the same manner as for the case of the vehicle 1 waiting to make a left turn.

FIG. 1 illustrates a case when visually checking turning left of the forefront oncoming vehicle 2 and the second oncoming vehicle 3. Luminescent materials 4 which emit light upon sensing blinking of turn signals are arranged in a zone along the center line on the road surface.

Figure 3:
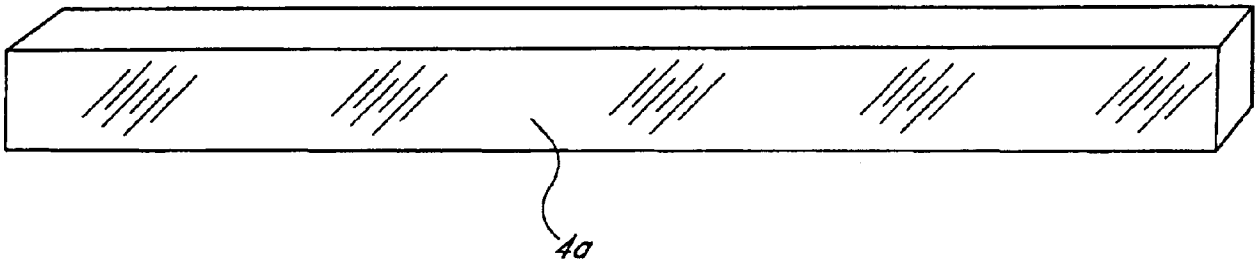
FIG. 3 is a schematic illustration of an embodiment of a reflecting mirror used in the present invention.
Figure 4:
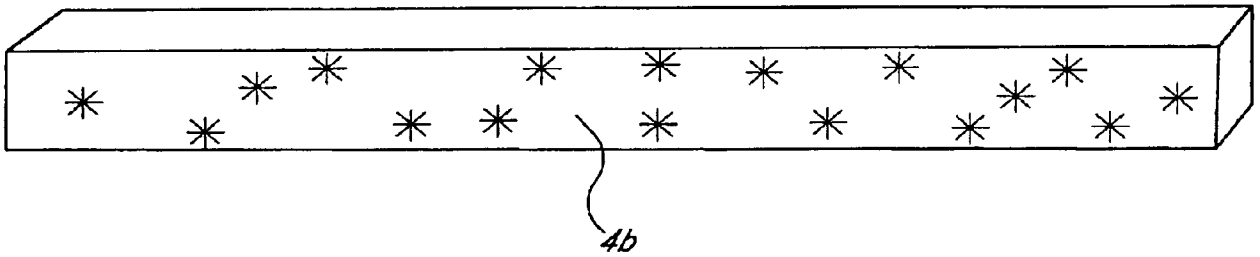
FIG. 4 is a schematic illustration of an embodiment of a luminescent paint used in the present invention.
Figure 5:
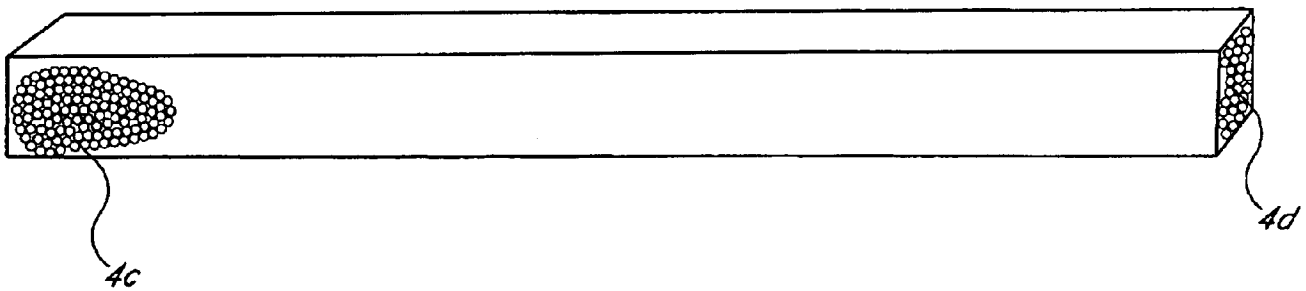
FIG. 5 is a schematic illustration of an embodiment of an optical fiber used in the present invention.

FIG. 3 shows an embodiment of a reflecting mirror 4*a*, FIG. 4 shows an embodiment of a luminescent paint 4*b*, and FIG. 5 shows an embodiment of an optical fiber having two ends 4*c*, 4*d*.

In the present invention, "zone" is not limited to luminescent materials connected one after another to form a zone, but also includes luminescent materials arranged in broken pieces to form a zone as a whole.

Because the turn signal of a vehicle is generally located near a headlight, the luminescent materials installed on the road surface are required to emit light in the direction of the vehicle waiting to make a left turn upon sensing light going in a diagonal and downward direction from the turn signal. In order to achieve the above, reflecting mirrors 4*a* used as a luminescent material include those with many irregularities provided on the surface of a flat plate, for example, by attaching a limitless number of spherical glass beads, by causing diffused reflection by a wavelike shape or by securing the direction of light toward the waiting left-turn vehicle by lining up many concave mirrors, convex mirrors and slantingly placed flat mirrors. Additionally, a paint in which fine glass beads are mixed to give light reflection can also be applied.

As another preferred mode for carrying out the invention, by installing a large number of one end 4*c* of optical fibers zonally in the direction of the turn signal of a vehicle and directing the other end 4*d* in the direction of a waiting left-turn vehicle, the light from the turn signal can reach the waiting left-turn vehicle with small loss.

In the above-mentioned embodiment, the light from turn signals of an oncoming vehicle is communicated by converting the direction of the light. Due to the amount of the light from the turn signals, this embodiment is particularly effective in cloudy weather and rainy weather and at night rather than in the clear daytime.

Consequently, as luminescent materials which can function effectively in the clear daytime, by combining photo acceptance units such as CDS photoelectric elements and light-emitting diodes (LEDs) and arranging many of them zonally, LEDs emit light by sensing the light of the turn signal, which is detected by photoelectric elements (sensors), and the light emitted from the LEDs can be easily seen in the clear daytime by waiting left-turn vehicles. At this time, because the color of the light emitted by the turn signal is orange, it is further effective if placing a filter mainly filtering out the orange color in front of the photoelectric elements.

In the above-mentioned embodiment, devices detecting the left-turn intention of the second oncoming vehicle are described. A device detecting right-turn intention is described below with reference with FIG. 2.

To detect left-turn intentions, the driver of a waiting left-turn vehicle can easily visually check light if the light of a turn signal is emitted along the centerline of a road. To detect right-turn conditions, even if luminescent materials are installed zonally on the side of the road, it is difficult for the waiting left-turn driver to visually check the light from the turn signal because the light is out of his/her line of vision.

Thus, to detect the right-turn intentions, sensors are installed zonally on the side of the road, and it becomes necessary to arrange light-emitting elements emitting light from the sensors in the positions from which the driver of a waiting left-turn vehicle near the intersection can visually check the luminescent materials.

For this reason, as shown in the figure, while one end of many optical fibers 5 (sensors) is installed zonally on the side of the road, the other end of the optical fibers 6 (light-emitting elements) is positioned near the intersection by integrating the optical fibers. Likewise, regarding a device in which photo acceptance units such as CDS photoelectric elements and light-emitting diodes (LEDs), photo acceptance units are installed by arranging many of them zonally and LEDs, which are light-emitting units, are installed near the intersection.

Additionally, in the present invention, both left-turn sensing light-emitting units and right-turn sensing light-emitting units can be installed on the road surface.

The operation of the embodiment is described below.

If the traffic signal ahead is green, viewing the driving intentions of the oncoming traffic, a driver of a vehicle 1 intending to turn left arrives at an intersection 10 and waits for an oncoming vehicle 2 if the oncoming vehicle 2 goes straight on. At this time, if the second oncoming vehicle 3 is a left-turn vehicle, the driver of the waiting left-turn vehicle 1 can make a left turn easily after waiting for the forefront oncoming vehicle 2 going straight on because he/she can visually check the blinking turn signal of the second oncoming vehicle 3 directly or via luminescent materials installed near the center line of the road which are emitting light upon sensing light of blinking turn signals. If the second oncoming vehicle 3 is a right-turn vehicle, the driver of the waiting left-turn vehicle 1 can make a left turn easily after waiting for the forefront oncoming vehicle 2 going straight on and is seeing a right turn being made by the second oncoming vehicle making a right turn because light-emitting units installed near the intersection emit light upon sensing blinking of the turn signal of the right-turn vehicle.

Effects

As described above, because the present invention, a device wherein luminescent material emits light upon sensing blinking of the turn signal of a second oncoming vehicle following a forefront oncoming vehicle about to enter the intersection, is installed in a position from which the driver of a vehicle waiting to make a left turn is able to visually check the luminescent material, the driver waiting to make a left turn can surely and accurately visually check the traveling intention of the second oncoming vehicle. This can reduce the burden placed on the driver waiting to make a left turn, improves traffic safety at intersections, and greatly contributes to society. Additionally, because the present invention does not require controls such as microcomputers, it is economical. Because it is simply installed on the road surface, maintenance and inspections are easy and installation is also easy.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A method of making a toil turn in a waiting vehicle at an intersection where vehicles travel on the right side of a road, wherein a first oncoming vehicle is entering the intersection and wherein a second oncoming vehicle following the first oncoming vehicle has its left-turn signal on, said method comprising:

sensing blinking signals of the left-turn signal of the second oncoming vehicle from a first end of an optical fiber installed linearly along the centerline of the road, said first end being directed facing a driver of the waiting vehicle, wherein the blinking signals are reflected to said first end from a second end of the optical fiber, wherein the optical fiber is longer than the length of the first oncoming vehicle such that said second end is directed to receive the blinking signals of the left-turn signal of the second oncoming vehicle and reflect the light to the first end and the waiting vehicle; the first end of the optical fiber comprises light-emitting diodes and the second end of the optical fiber comprises CDS photoelectric elements; and the waiting vehicle turning left when the driver deems conditions to be said taking into consideration the presence of the blinking signals sensed.

* * * * *

UNITED STATES PATENT AND TRADEMARK OFFICE

CERTIFICATE OF CORRECTION

PATENT NO. : 6,827,522 B2
DATED : December 7, 2004
INVENTOR(S) : Kohichiro Kodama and Yoshihiro Kodama It is certified that error appears in the above-identified patent and that said Letters Patent is hereby corrected as shown below:

Column 6,
Line 53, please delete “toil” and insert -- left --, therefor.

Column 8,
Line 2, please delete “said” and insert -- safe --, therefor.

Signed and Sealed this

Fifteenth Day of November, 2005

JON W. DUDAS
*Director of the United States Patent and Trademark Office*